US006367432B1

(12) United States Patent
Araki

(10) Patent No.: US 6,367,432 B1
(45) Date of Patent: Apr. 9, 2002

(54) TWO-STROKE CYCLE INTERNAL COMBUSTION ENGINE

(75) Inventor: Tsuneo Araki, Tokyo (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 09/567,742

(22) Filed: May 10, 2000

(30) Foreign Application Priority Data

May 14, 1999 (JP) ..... 11-134091
Sep. 16, 1999 (JP) ..... 11-261780

(51) Int. Cl.[7] ..... F02B 33/04
(52) U.S. Cl. ..... 123/73 R; 123/65 P; 123/73 A
(58) Field of Search ..... 123/73 R, 73 A, 123/73 PP, 65 P, 65 W

(56) References Cited

U.S. PATENT DOCUMENTS 4,821,687 A * 4/1989 Iwai ..... 123/65 W
5,207,190 A * 5/1993 Torigai et al. ..... 123/73 A
5,490,483 A * 2/1996 Tanikake et al. ..... 123/65 P
5,572,960 A * 11/1996 Tsushima et al. ..... 123/73 A
5,586,525 A * 12/1996 Masse ..... 123/73 PP
5,870,981 A * 2/1999 Knaus et al. ..... 123/73 PP
6,016,776 A * 1/2000 Jonsson ..... 123/73 PP
6,112,708 A * 9/2000 Sawada et al. ..... 123/73 PP
6,135,072 A * 10/2000 Kishita ..... 123/73 A
6,216,650 B1 * 4/2001 Noguchi ..... 123/73 A
6,223,705 B1 * 5/2001 Sato et al. ..... 123/73 PP

FOREIGN PATENT DOCUMENTS

JP 5033657 2/1993
JP 9125966 5/1997
JP 10121975 5/1998

* cited by examiner

*Primary Examiner*—Willis R. Wolfe
*Assistant Examiner*—Jason Benton
(74) *Attorney, Agent, or Firm*—Baker Botts L.L.P.

(57) ABSTRACT

A two-stroke cycle internal combustion engine has a quaternary Schnürle-type scavenging system that is configured such that the capacity of a pair of second scavenging passageways are made larger than the capacity of a pair of first scavenging passageways, so that during the descending stroke of the piston, air is allowed to be introduced into the combustion actuating chamber from the second scavenging passageways prior to the introduction of the air-fuel mixture and at the same time, a relatively large quantity of air is allowed to be introduced into the combustion actuating chamber from the first scavenging passageways over a longer period of time as compared with the period of time in which air is introduced from the second scavenging passageways.

23 Claims, 10 Drawing Sheets

TWO-STROKE CYCLE INTERNAL COMBUSTION ENGINE

BACKGROUND OF THE INVENTION

The present invention relates to a two-stroke cycle internal combustion engine that is suited for use in a portable power working machine, for instance, and in particular to a two-stroke cycle internal combustion engine which is capable of minimizing the quantity of so-called blow-by, i.e., the quantity of unburned air-fuel mixture that is discharged from the engine with the exhaust gases.

An ordinary two-stroke cycle internal combustion engine which is conventionally used in a portable power working machine, such as a chain saw, is constructed such that an ignition plug is disposed at the head portion of the cylinder, and an intake port, scavenging ports and an exhaust port, which are to be opened and closed by a piston, are provided at the trunk portion of the cylinder. In such a two-stroke cycle internal combustion engine, one cycle of the operation of the engine is accomplished by two strokes of the piston—the piston does not perform strokes which are exclusively assigned to the intake of an air-fuel mixture or the exhaust of combustion gases.

More specifically, during each ascending stroke of the piston, an air-fuel mixture is introduced from the intake port into the crank chamber disposed below the piston. When the piston descends, the air-fuel mixture in the crank chamber is pre-compressed, producing a compressed gas mixture, which is then utilized for exhausting the combustion gas from the exhaust port; i.e., the compressed gas mixture is blown into a combustion actuating chamber, which is disposed above the piston, so as to expel the combustion gas toward the exhaust port. (Although it might variously be called a combustion chamber, an actuating chamber, a cylinder chamber, etc., these chambers are generically referred to in the present specification as "the combustion actuating chamber.") In other words, since the scavenging of the combustion gas is effected by making use of the gas flow of the air-fuel mixture, the unburned air-fuel mixture is more likely to be mingled into the combustion gas (exhaust gas), thereby increasing the quantity of so-called blow-by, i.e., the quantity of unburned air-fuel mixture that is discharged from the engine into the atmosphere with the exhaust gases. Because of this, the two-stroke cycle internal combustion engine is not only inferior in fuel efficiency but also disadvantageous in that a large amount of undesirable components, such as HC (unburned components in a fuel) and CO (incomplete combustion components in a fuel), are included in the exhaust gas as compared with a four-stroke cycle engine Therefore, even if the two-stroke cycle engine is small in capacity, the influence of these undesirable components on environmental contamination should not be disregarded.

With a view to solving these problems, various proposals have been made for two-stroke cycle internal combustion engines in which air is introduced into the combustion actuating chamber prior to the introduction of air-fuel mixture so as to scavenge the combustion gas (see, for example, Japanese Patent Unexamined Publications H9-125966 and H5-33657). However, even with these proposals, it is difficult to sufficiently reduce the quantity of blow-by. Additionally, the layout and structure of the parts of the engine, including the air-fuel mixture passageway and air passageway, are not sufficiently sophisticated, thus causing the engine to increase in overall size. Therefore, the two-stroke cycle internal combustion engines proposed in the aforementioned publications might be further improved for the purpose of mounting them on a portable power working machine.

A so-called binary scavenging system is now adopted in the conventional Schnürle-type scavenging two-stroke internal combustion engine, wherein a pair of scavenging ports are located symmetrically with respect to a longitudinal plane that bisects the exhaust port, and a portion of the scavenging flow of the air-fuel mixture that is blown out of the pair of scavenging ports impinges against a stationary inner wall of the cylinder (cylinder bore). A so-called quaternary scavenging system comprising two pairs of scavenging ports—i.e., an additional pair of scavenging ports is further added to the aforementioned binary scavenging system—is also known.

However, even in the two-stroke cycle internal combustion engine having a quaternary scavenging system, it is impossible to sufficiently minimize the quantity of so-called blow-by even if, according to the method conventionally proposed, the scavenging of combustion gas is performed by introducing air prior to the introduction of air-fuel mixture into the combustion actuating chamber as in the case of the two-stroke cycle internal combustion engine having a binary scavenging system. Furthermore, the layout and structure of the parts of the engine, including the air-fuel mixture passageway and air passageway, are not sufficiently sophisticated, thus causing the engine to increase in size. Therefore, there remains a need for the two-stroke cycle internal combustion engine having a quaternary scavenging system to be further improved for uses such as in portable power working machines

BRIEF SUMMARY OF THE INVENTION

The present invention has been made to solve the aforementioned problems. It is, accordingly, an object of the present invention to provide a two-stroke cycle internal combustion engine having a quaternary scavenging system, which is capable of minimizing the quantity of blow-by, capable of improving the fuel consumption and power of the engine, capable of reducing the content of undesirable components in the exhaust gas, and capable of rationally and compactly arranging the parts of the engine.

With a view to attaining the aforementioned objects, a two-stroke cycle internal combustion engine, which includes a cylinder and a piston defining a combustion actuating chamber and a crankcase below the piston and defining a crank chamber, has a quaternary Schnürle-type scavenging system that includes an exhaust port, a pair of first scavenging passageways communicating the combustion actuating chamber with the crank chamber and disposed closer to the exhaust port, and a pair of second scavenging passageways communicating the combustion actuating chamber with the crank chamber and disposed farther from the exhaust port. The first scavenging passageways are disposed symmetrically with respect to a longitudinal plane that bisects the exhaust port. Similarly, the second scavenging passageways are disposed symmetrically with respect to the longitudinal plane. An air passageway is arranged for introducing air into the first scavenging passageways, and an air-fuel mixture passageway is provided for introducing an air-fuel mixture from an air-fuel-generating device into the crank chamber. The scavenging system is configured such that during a descending stroke of the piston, the exhaust port opens first, a first scavenging port formed at a downstream end of each first scavenging passageway opens after the exhaust port opens, and a moment later, a second scavenging port disposed at a downstream end of each second scavenging passageway opens, whereby air is introduced into the combustion actuating chamber from each first scavenging port prior to the introduction of the air-fuel mixture into the combustion actuating chamber from each second scavenging port.

In an advantageous construction of the two-stroke cycle internal combustion engine according to the first embodiment, a communicating passageway communicating with the downstream end of the air-fuel mixture passageway communicates the crank chamber with the combustion actuating chamber via an air-fuel mixture-feeding port provided at the downstream end of the communicating passageway. The air-fuel mixture-feeding port is configured to open substantially simultaneously with the second scavenging ports.

In another preferred embodiment of the two-stroke cycle internal combustion engine according to the present invention, the air passageway and the air-fuel mixture passageway are provided respectively with a check valve.

In yet another preferred embodiment of the present invention, the pair of first scavenging passageways are combined at a place close to the crank chamber, and end portions of said pair of first scavenging passageways which are disposed close to the crank chamber are contracted.

In the first embodiment of a two-stroke cycle internal combustion engine according to the present invention, the air passageway and the air-fuel mixture passageway are preferably arranged adjacent each other, one above the other, and the air-fuel mixture blown out of the air-fuel mixture-feeding port of the communicating passageway is designed to be blown toward a combustion chamber of the combustion actuating chamber.

In a specific preferred embodiment of the present invention, the air-fuel-generating device is a carburetor, which includes portions of the air passageway and the air-fuel mixture passageway, each such portion having a throttle valve. The throttle valves are interlocked with each other.

In a two-stroke cycle internal combustion engine of the present invention as described above, the ambient air is inducted through the air passageway into the first scavenging passageway and the crank chamber so as to be held therein during the ascending stroke of the piston, and the air-fuel mixture fed from the air-fuel-generating device is inducted into the air-fuel mixture passageway, the crank chamber and the second scavenging passageway so as to also be held therein.

When the air-fuel mixture inside the combustion actuating chamber disposed above the piston is ignited and burns, the piston is pushed downwardly due to the generation of combustion gas. In the descending stroke of the piston, an exhaust port opens first, and when the piston is further descended, a first scavenging port provided at a downstream end of each first scavenging passageway is opened so as to allow air which has been held in the first scavenging passageway and the crank chamber and compressed by the descending of the piston to be blown out of the first scavenging port into the combustion actuating chamber disposed above the piston, thereby allowing the combustion gas to be pushed toward the exhaust port by the air.

When the piston further descends after the first scavenging port has been opened, second scavenging ports at the downstream ends of the second scavenging passageways and the air-fuel mixture-feeding port are opened a moment after the first scavenging ports have opened (in other words, for example, 10 degrees later in terms of the crank angle), thereby allowing the relatively condensed air-fuel mixture existing inside the air-fuel mixture passageway to be blown from the second scavenging ports and from the air-fuel mixture-feeding port into the combustion chamber of the combustion actuating chamber. The air-fuel mixture thus blown out is prevented from being mixed with the combustion gas due to the presence of an air layer that has been introduced therein in advance from the first scavenging ports, thereby allowing the air-fuel mixture to circulate in the vicinity of the combustion chamber.

Thereafter, throughout almost all of the scavenging period, air is introduced through the first scavenging ports into the combustion actuating chamber, while throughout almost all of the scavenging period, the air-fuel mixture is introduced, through the second scavenging ports and the air-fuel mixture-feeding port, into the combustion actuating chamber.

Thusly, in the first embodiment of the internal combustion engine of the invention, the first scavenging passageways are employed exclusively for the passage of air, while the second scavenging passageways are employed exclusively for the passage of air-fuel mixture, and the second scavenging ports and the air-fuel mixture-feeding port are opened a moment later after the first scavenging ports open, thereby allowing a relatively condensed air-fuel mixture to be blown out of the second scavenging ports and the air-fuel mixture-feeding port toward the combustion chamber of the combustion actuating chamber, and preventing the air-fuel mixture thus blown out from being mixed with the combustion gas due to the presence of an air layer that has been introduced therein in advance. The air-fuel mixture circulates in the vicinity of the combustion chamber and hence promotes a stratified combustion. As a result, the quantity of blow-by is reduced to a minimum, and at the same time, the air-fuel mixture can be easily ignited, thus making it possible to improve combustion for greater fuel economy and to reduce the content of undesirable components in the exhaust gas.

Furthermore, since the air passageway and the air-fuel mixture passageway are arranged side by side, the parts of the engine can be rationally and compactly arranged, thus making it possible to easily mount the engine on a portable power working machine.

In addition, since the feeding of air is conducted not through an outside pump but through a piston pumping, the entire structure of the engine can be simplified and the manufacturing cost of the engine can be reduced.

A two-stroke cycle internal combustion engine according to a second embodiment is a quaternary schnürle-type scavenging system and has a pair of first scavenging passageways communicating the combustion actuating chamber with a crank chamber and disposed closer to the exhaust port, and symmetrically with respect to a longitudinal plane which bisects the exhaust port and a pair of second scavenging passageways communicating the combustion actuating chamber with the crank chamber and disposed farther from the exhaust port and located symmetrically with respect to the longitudinal plane that bisects the exhaust port. An air passageway introduces air into the first scavenging passageways, and an air-fuel mixture passageway introduces an air-fuel mixture from an air-fuel-generating device into the crank chamber.

During the descending stroke of the piston and at least in the initial stage of the scavenging period during which a first scavenging port formed at a downstream end of each first scavenging passageway and a second scavenging port formed at a downstream end of each second scavenging passageway are opened, only air is allowed to be introduced into the combustion actuating chamber from the first and second scavenging ports.

In the second embodiment of the engine, the capacity of each second scavenging passageway is preferably made larger than the capacity of each first scavenging passageway, so that during the descending stroke of the piston, air is allowed to be introduced into the combustion actuating chamber from the second scavenging port prior to the introduction of the air-fuel mixture and at the same time, a relatively large quantity of air is allowed to be introduced into the combustion actuating chamber from the first scavenging port over a longer period of time as compared with a period of time in which air is introduced from the second scavenging port.

It is advantageous in this case that only air is allowed to be introduced through the first scavenging ports into the combustion actuating chamber throughout the entire scavenging period.

In the second embodiment of the two-stroke cycle internal combustion engine, it is advantageous to include a communicating passageway communicating the crank chamber with the combustion actuating chamber at the downstream end of the air-fuel mixture passageway, such that during the descending stroke of the piston, the exhaust port opens first, the first scavenging ports and the second scavenging ports are then opened, and a moment later, an air-fuel mixture-feeding port provided at the downstream end of the communicating passageway is opened, and such that air is introduced into the combustion actuating chamber prior to the introduction of the air-fuel mixture.

Other two-stroke cycle internal combustion engines according to the present invention advantageously may include the following features: (1) During the descending stroke of the piston, the exhaust port opens first, and then, the first scavenging ports and the second scavenging ports are simultaneously opened; (2) The air passageway is provided with a check valve; (3) A single air outlet port disposed at the downstream end of the air passageway is communicated with both the first scavenging passageway and the second scavenging passageway, and the air outlet port is provided with a single check valve; (4) The pair of first scavenging passageways are combined at a place close to the crank chamber; (5) The end portions of the pair of first scavenging passageways which are disposed close to the crank chamber are contracted; (6) The air-fuel mixture passageway is provided with a check valve; (7) The air passageway and the air-fuel mixture passageway are arranged side by side; (8) The air-fuel mixture blown out of the air-fuel mixture-feeding port of the communicating passageway is blown toward a combustion chamber of the combustion actuating chamber; (9) The air-fuel-generating device is a carburetor, which includes portions of the air passageway and the air-fuel mixture passageway, each being provided with a throttle valve, and the throttle valves being interlocked with each other.

In operation of a two-stroke cycle internal combustion engine according to the second embodiment described above, the external air is drawn in through the air passageway into the first scavenging passageways, the second scavenging passageways and the crank chamber so as to be held therein in the ascending stroke of the piston, and the air-fuel mixture fed from the air-fuel-generating device is drawn into the air-fuel mixture passageway and the crank chamber so as to be also held therein.

When the air-fuel mixture inside the combustion actuating chamber disposed above the piston is ignited and burns, the piston is pushed downwardly due to the generation of combustion gas. In the descending stroke of the piston, the air and air-fuel mixture existing inside the crank chamber, the first scavenging passageways and the second scavenging passageways are compressed. The exhaust port opens first, and when the piston has further descended, the first scavenging ports provided at downstream ends of the first scavenging passageways and the second scavenging ports provided at downstream ends of the second scavenging passageways are opened simultaneously. In the initial stage of the scavenging period during which the first and second scavenging ports are opened, only the air compressed by the piston and residing in the first and second scavenging passageways is allowed to be introduced into the combustion actuating chamber from the first and second scavenging ports.

Subsequently, when the piston has descended further, the air residing in the first scavenging passageway is allowed to be continuously introduced into the combustion actuating chamber from the first scavenging ports (preferably, the air is introduced throughout the entire scavenging period), whereas the introduction of air into the combustion actuating chamber from the second scavenging ports ends. Namely, when a certain period of time has elapsed after the second scavenging ports have been opened, since all of the air inside the second scavenging passageways will have already been introduced into the combustion actuating chamber from the second scavenging ports, the air-fuel mixture that has been pre-compressed in the crank chamber is introduced, following the aforementioned introduction of air from the second scavenging ports via the second scavenging passageways into the combustion actuating chamber until the scavenging period ends.

When the piston further descends after the first and second scavenging ports have been opened, the air-fuel mixture-feeding port is opened a moment after the first and second scavenging ports have opened (eg., 10 degrees later in terms of the crank angle), thereby allowing the relatively condensed air-fuel mixture existing inside the air-fuel mixture passageways (and the crank chamber) to be blown from the air-fuel mixture-feeding ports into the combustion chamber of the combustion actuating chamber until the scavenging period ends, thereby allowing the air-fuel mixture to circulate in the vicinity of the combustion chamber.

In the case of the quaternary scavenging type two-stroke internal combustion engine according to the first embodiment wherein the first scavenging port is exclusively used for air and the second scavenging port is exclusively used for an air-fuel mixture, the combustion exhaust gas is allowed to remain in the vicinity of the inner wall of the cylinder which is located opposite to the exhaust port. By contrast, in the two-stroke internal combustion engine of the second embodiment, since only air is allowed to be introduced into the combustion actuating chamber from both of the first and second scavenging ports in the initial stage of the scavenging period, the combustion exhaust gas is substantially not allowed, due to this air, to remain in the cylinder, including a portion in the vicinity of the inner wall of the cylinder which is located opposite to the exhaust port, but is caused to be pushed toward the exhaust port so as to be discharged therefrom At the same time, an air layer is caused to be formed between the combustion exhaust gas and the air-fuel mixture that is introduced later into the combustion actuating chamber from the air-fuel mixture-feeding port and the second scavenging ports. Therefore, due to the air layer, a mixing between the air-fuel mixture and the combustion exhaust gas can be effectively prevented, thereby realizing an almost complete stratified scavenging.

In the second embodiment, the first scavenging passageways are employed exclusively for the passage of air, while the second scavenging passageways are employed exclusively for the passage of the air-fuel mixture only after the initial stage of the scavenging period during which the second passageways supply air. The air-fuel mixture-feeding port opens a moment later after the first scavenging ports and the second scavenging ports open, thereby allowing a relatively condensed air-fuel mixture to be blown out of the second scavenging ports and the air-fuel mixture-feeding port toward the combustion chamber of the combustion actuating chamber after a middle stage of the scavenging period, thereby preventing the air-fuel mixture thus blown out from being mixed with the combustion exhaust gas due to the presence of an air layer that has been previously introduced, thus enabling the air-fuel mixture to circulate in the vicinity of the combustion chamber and hence, promoting a stratified combustion. As a result, the quantity of blow-by can be reduced, and at the same time, the air-fuel mixture can be easily ignited, thus making it possible to improve the fuel consumption and to reduce the content of undesirable components in the exhaust gas.

Further, since the air passageway and the air-fuel mixture passageway are arranged side by side, the parts of the engine can be rationally and compactly arranged, thus making it possible to easily mount the engine on a portable power working machine.

Furthermore, since the feeding of air is conducted not through an outside pump, but through a piston pumping, the entire structure of the engine can be simplified and the manufacturing cost of the engine can be reduced.

DETAILED DESCRIPTION OF THE EMBODIMENTS

Figure 2:
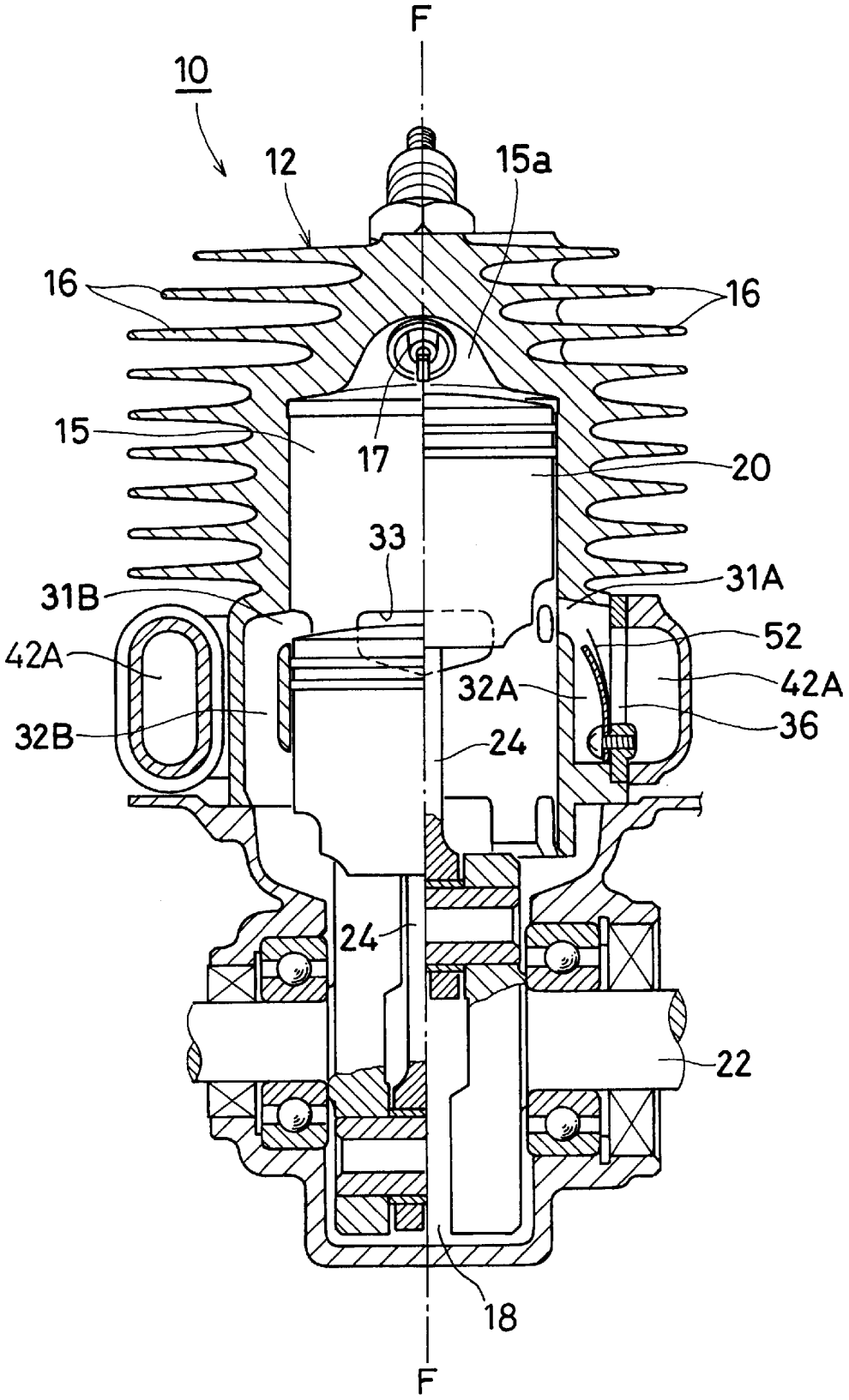
FIG. 2 is a cross-sectional view taken along the line II—II in FIG. 1.

For the convenience of illustration and explanation, the portion to the left of the line F—F in FIG. 2 illustrates a longitudinal cross-sectional view taken along the center of a second scavenging port at the bottom dead center of the piston, while the portion to the right of the line F—F in FIG. 2 illustrates a longitudinal cross-sectional view taken along the center of a first scavenging port at the top dead center of the piston.

The two-stroke cycle internal combustion engine 10 according to the first embodiment is a small air-cooled two-stroke cycle gasoline engine having a quaternary scavenging system, which is adapted to be employed in a portable working machine. The engine 10 comprises a cylinder 12 in which a piston 20 is movingly disposed, and a crankcase 14 axially supporting a crank shaft 22 for reciprocatively moving the piston 20 up and down through a connecting rod 24. The cylinder 12 is provided, on the outer circumferential wall thereof, with a plurality of cooling fins 16, and, at the head portion thereof, with a squish-dome shape (semi-spherical) combustion chamber 15*a* constituting a combustion actuating chamber 15. An ignition plug 17 protrudes into the combustion chamber 15*a*.

Figure 1:
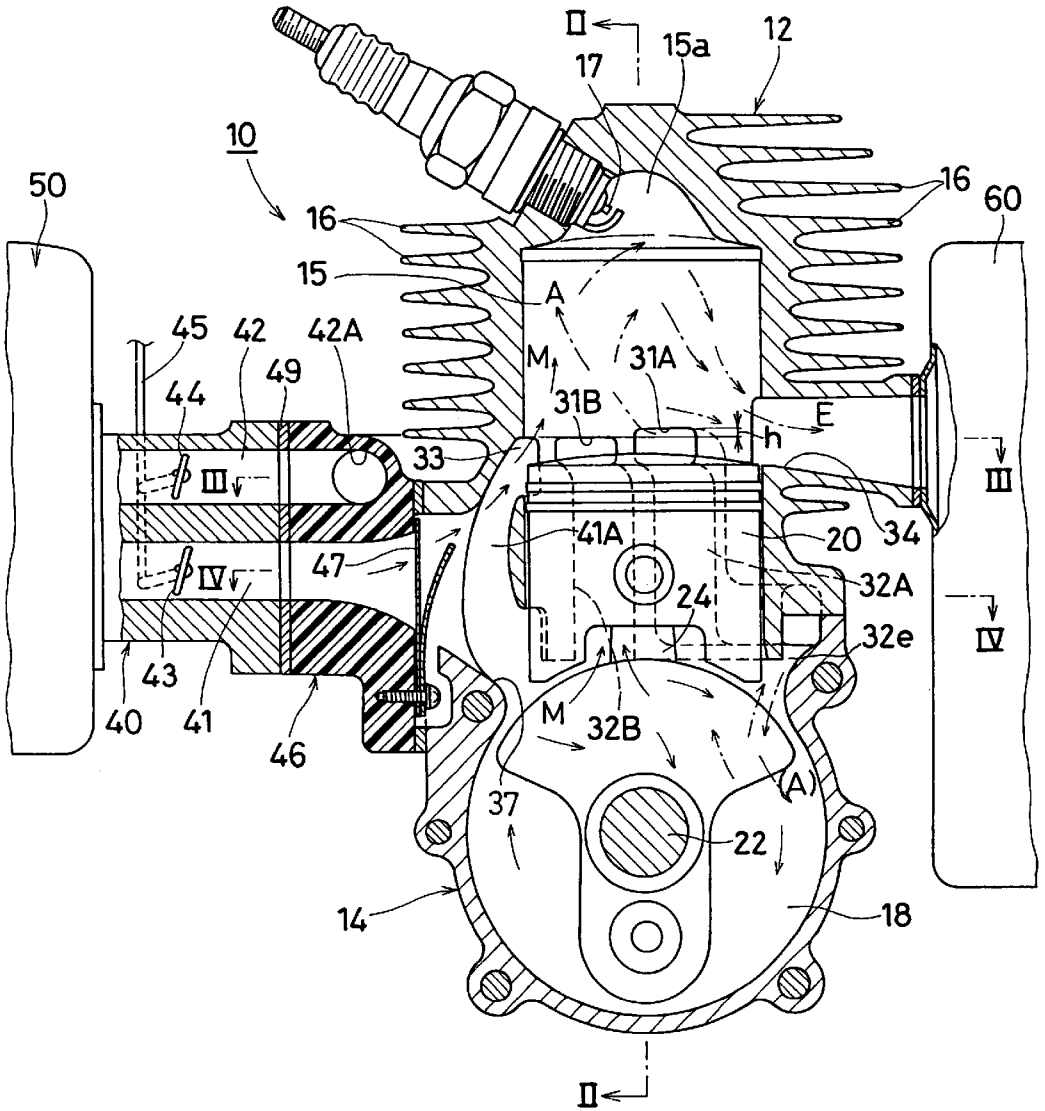
FIG. 1 is a longitudinal sectional view illustrating a first embodiment of a two-stroke cycle internal combustion engine according to the present invention.

An exhaust port 34 is formed at one side (the right side in FIG. 1) of the trunk portion of the cylinder 12. A pair of first scavenging passages 32A disposed symmetrically with respect to a longitudinal plane F—F (FIG. 2) that bisects the exhaust port 34 and located closer to the exhaust port 34 communicate the combustion actuating chamber 15 disposed above the piston 20 with a crank chamber 18 of the crankcase 14 and constitute part of a Schnürle-type scavenging system. A pair of second scavenging passages 32B disposed farther from the exhaust port 34 and located symmetrically with respect to the plane F—F that bisects the exhaust port 34 communicate the combustion actuating chamber 15 with the crank chamber 18 of crankcase 14.

At the upper end (downstream end) of the first scavenging passages 32A, there is formed a pair of the first scavenging ports 31A which open to the combustion actuating chamber 15. At the upper end (downstream end) of the second scavenging passages 32B also, there is formed a pair of the second scavenging ports 31B which open to the combustion actuating chamber 15.

On the other side of the cylinder 12, which is opposite to where the exhaust port 34 opens (the left side in FIG. 1), there is mounted, via a bored heat insulator 46 and a packing plate 49, a carburetor 40 functioning as an air-fuel mixture-generating device An air cleaner 50 is attached to the upstream side of the carburetor 40.

The carburetor 40 includes an upstream portion of an air passageway 42 for conducting air A that has been cleaned by the air cleaner 50 to the first scavenging passageways 32A and an upstream portion of an air-fuel mixture passageway 41 for conducting an air-fuel mixture M that has been generated by the carburetor 40 to the combustion actuating chamber 15. The air passageway 42 and the air-fuel mixture passageway 41 are, respectively, provided with throttle valves 44 and 43, these throttle valves 44 and 43 being interlocked with each other through a link member 45.

Figure 3:
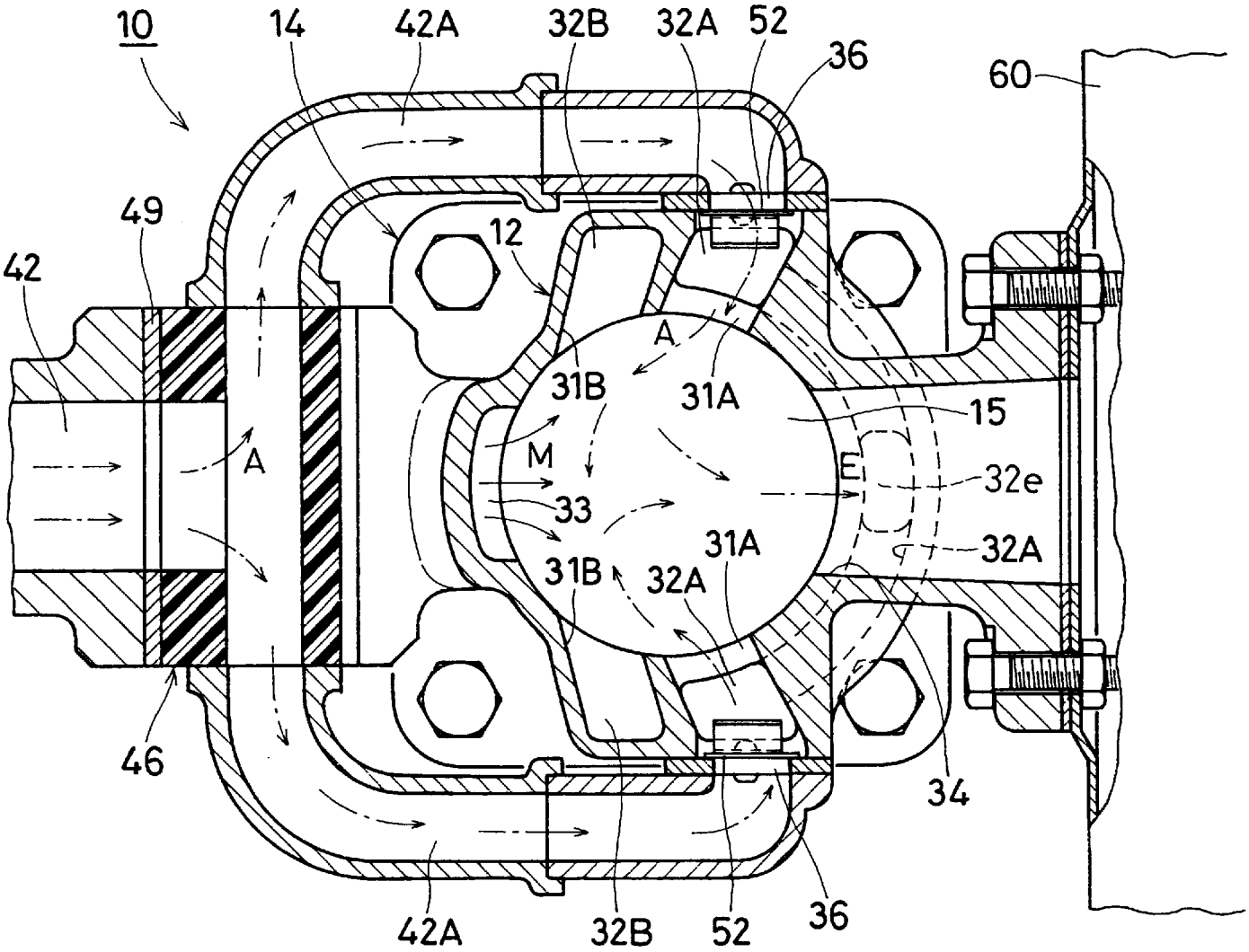
FIG. 3 is a cross-sectional view taken along the line III—III in FIG. 1.
Figure 4:
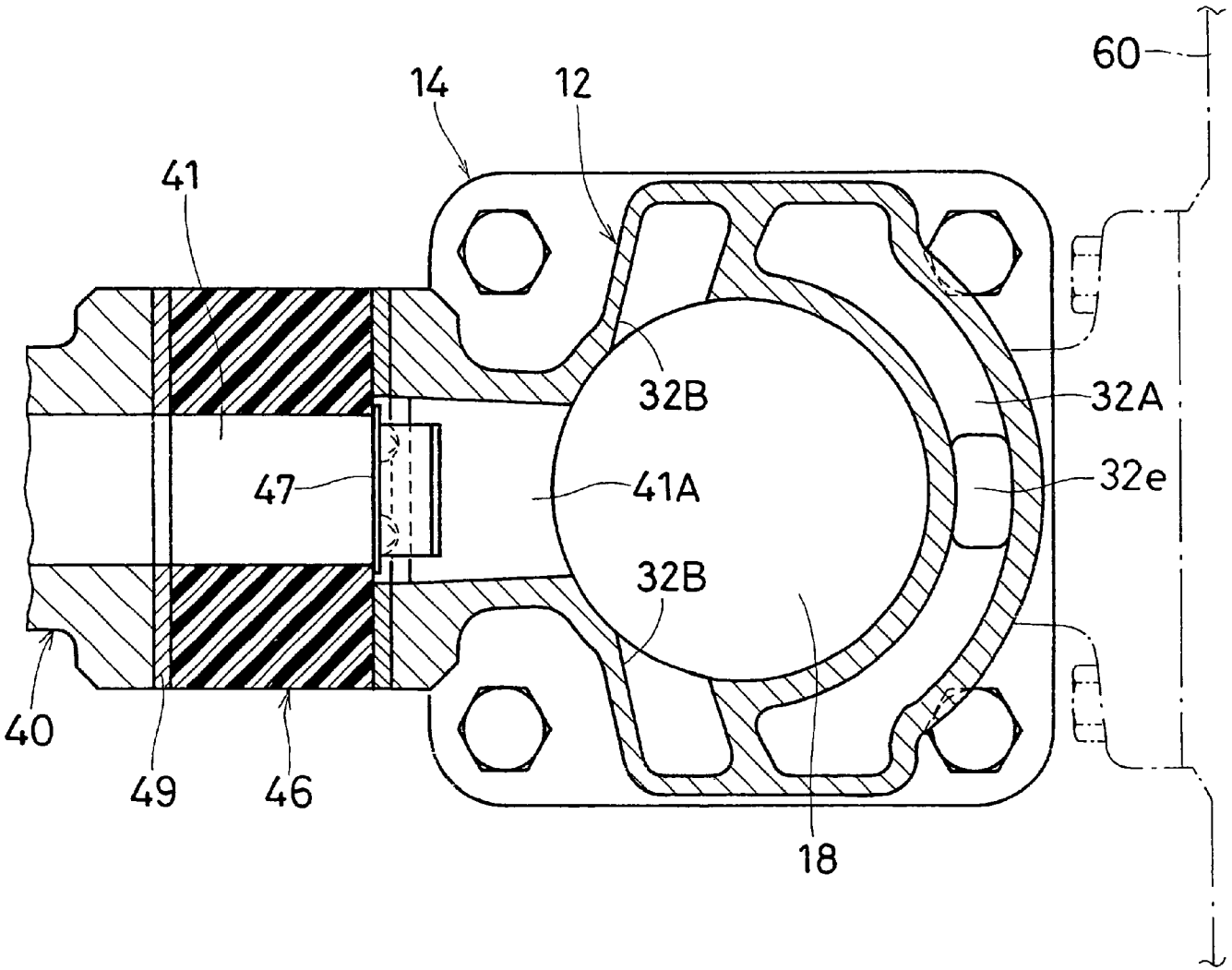
FIG. 4 is a cross-sectional view taken along the line IV—IV in FIG. 1.

The air passageway 42 and air-fuel mixture passageway 41 are arranged adjacent each other height-wise of the cylinder, and as clearly seen from FIGS. 2 and 3, the downstream part of the air passageway 42 is branched into two branch passageways 42A, each provided, at an air outlet port 36 at the downstream end thereof, with a stopper-attached reed valve 52 functioning as a check valve for preventing air A from escaping toward the branch passageways 42A during the descending movement of the piston 20. The air-fuel mixture passageway 41 is also provided, at the downstream side thereof, with a stopper-attached reed valve 47 attached to the heat insulator 46 and functioning as a check valve for preventing air-fuel mixture M from escaping toward the carburetor 40.

A communicating passageway 41A that communicates the combustion actuating chamber 15 with the crank chamber 18 is disposed at the downstream end of the air-fuel mixture passageway 41, and the downstream end (upper end) of the communicating passageway 41A is constituted by an air-fuel mixture-feeding port 33 which opens to the combustion actuating chamber 15 located over the piston 20, thereby allowing the air-fuel mixture M to blow out from the air-fuel mixture-feeding port 33 as well as from the second scavenging ports 31B formed at the downstream end of the second scavenging passageways 32B toward the combustion chamber 15*a* of the combustion actuating chamber 15. At the same time, the air-fuel mixture M coming from the air-fuel mixture passageway 41 and the communicating passageway 41A is also allowed to be introduced into the crank chamber 18 through a crank chamber port 37.

The pair of first scavenging passages 32A are combined at a portion thereof which is close to the crank chamber 18 and are additionally contracted at an end portion 32*e*, which is located close to the crank chamber 18 so as to prevent the air A from escaping into the crank chamber 18.

Figure 5:
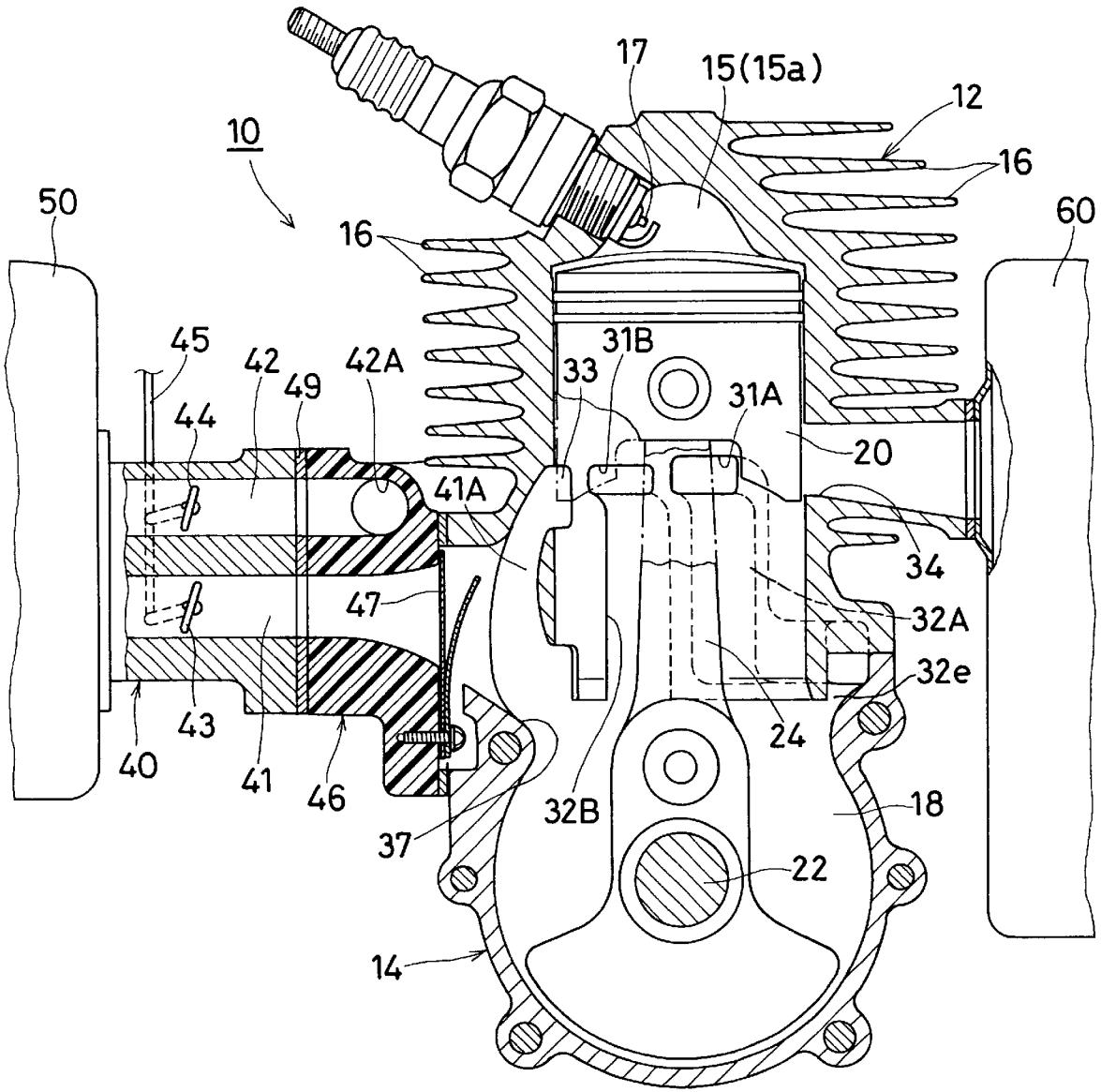
FIG. 5 is a longitudinal sectional view illustrating a state where the piston of the internal combustion engine shown in FIG. 1 is at the top dead center.
Figure 6:
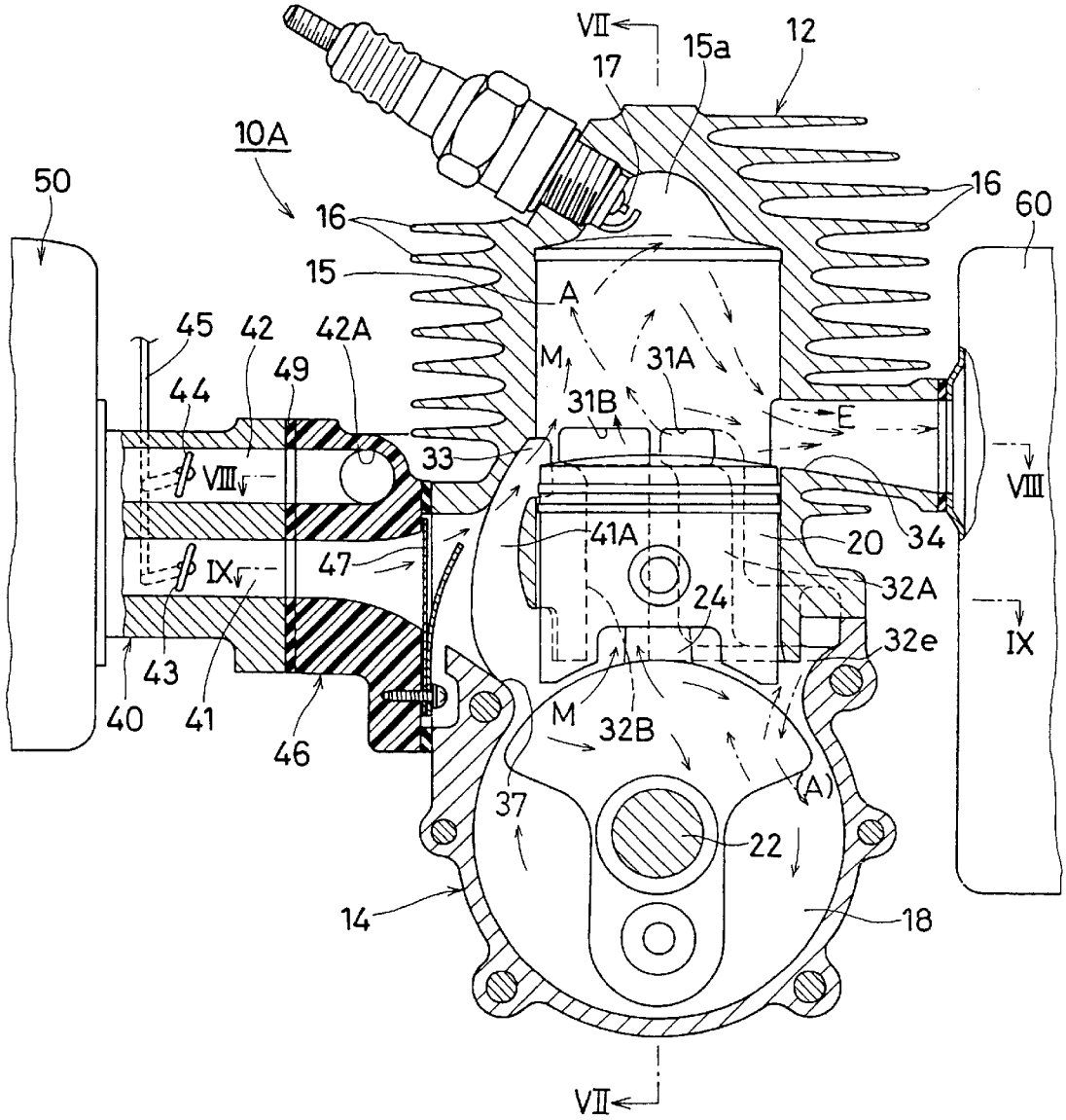
FIG. 6 is a longitudinal sectional view illustrating a second embodiment of a two-stroke cycle internal combustion engine according to the present invention.

In the operation of the two-stroke internal combustion engine 10 of the first embodiment which is constructed as described above, ambient air A is introduced through the air passageway 42, branch passageways 42A and the check valves 52 into the pair of right and left first scavenging passageways 32A as well as into the crank chamber 18 and held therein in the ascending stroke of the piston 20 (FIG. 5 shows a state wherein the piston 20 is positioned at the top dead center). Additionally, without being substantially mixed with air A, the air-fuel mixture is introduced from the carburetor 40 into the air-fuel mixture passageway 41 (including the communicating passageway 41A), into a portion of the crank chamber 18 and also into a pair of the right and left second scavenging passageways 32B, and held therein.

When the compressed air-fuel mixture M inside the combustion actuating chamber 15 disposed above the piston 20 is ignited and burns, the piston 20 is pushed down due to the generation of a combustion gas. In the descending stroke of the piston 20, the exhaust port 34 opens first, and when the piston 20 has further descended, the first scavenging ports 31A formed at the upper end of the first scavenging passageways 32A open so as to allow the air A which has been held in the first scavenging passageways 32A and the crank chamber 18 and compressed by the descending piston 20 to be blown from the first scavenging ports 31A into the combustion actuating chamber 15 disposed above the piston 20 (indicated by chained arrows in FIGS. 1 and 3), thereby allowing the combustion exhaust gas E (indicated by chained arrows in FIG. 1) to be pushed out through the exhaust port 34 into a muffler 60 by the air A.

When the piston 20 has further descended by a distance of "h" (FIG. 1) after the first scavenging ports 31A have opened, the second scavenging ports 31B and the air-fuel mixture-feeding port 33 open a moment after the first scavenging ports 31A have opened (e.g., about 10 degrees later in terms of the crank angle), thereby allowing the relatively condensed air-fuel mixture M (indicated by solid arrows in FIGS. 1 and 3) held inside the air-fuel mixture passageway 41 to be blown through the second scavenging ports 31B and the air-fuel mixture-feeding port 33 into the combustion chamber 15*a* of the combustion actuating chamber 15. The air-fuel mixture M thus blown out is prevented from being mixed with the combustion exhaust gas E due to the presence of the layer of air A that has been previously introduced, thereby allowing the air-fuel mixture M to circulate in the vicinity of the combustion chamber 15*a*.

In the internal combustion engine of the first embodiment, the first scavenging passageways 32A are employed exclusively for the passage of air, while the second scavenging passageways 32B are employed exclusively for the passage of air-fuel mixture. The second scavenging ports 31B and the air-fuel mixture-feeding port 33 open a moment after the scavenging ports 31A open, thereby allowing a relatively condensed air-fuel mixture M to be blown out of the second scavenging ports 31B and the air-fuel mixture-feeding port 33 into the combustion chamber 15*a* of the combustion actuating chamber 15 and preventing the air-fuel mixture M thus blown out from being mixed with the combustion exhaust gas E due to the presence of the layer of air A that has been previously introduced from the first ports 31A. Thus, the air-fuel mixture M circulates in the vicinity of the combustion chamber 15*a* and promotes a stratified combustion. As a result, the quantity of blow-by is reduced to a minimum and at the same time the air-fuel mixture M can be easily ignited, thus making it possible to improve fuel consumption and to reduce the content of undesirable components in the exhaust gas.

Furthermore, since the air passageway 42 and the air-fuel mixture passageway 41 are arranged side by side, the parts of the engine 10 can be rationally and compactly arranged, thus making it possible to easily mount the engine 10 on a portable power working machine.

Inasmuch as the feeding of air is conducted not through an outside pump, but through a piston pumping, the entire structure of the engine 10 can be simplified and the manufacturing cost of the engine 10 can be reduced.

In the above embodiment, the reed valves 52 are disposed as a check valve at the downstream end of the air passageway 42. These check valves 52 may be disposed at the upstream side (the heat insulator 46, for instance) of the air passageway 42.

Next, the second embodiment of the two-stroke cycle internal combustion engine according to the present invention will be explained with reference to FIGS. 6 to 10 of the drawings.

Figure 7:
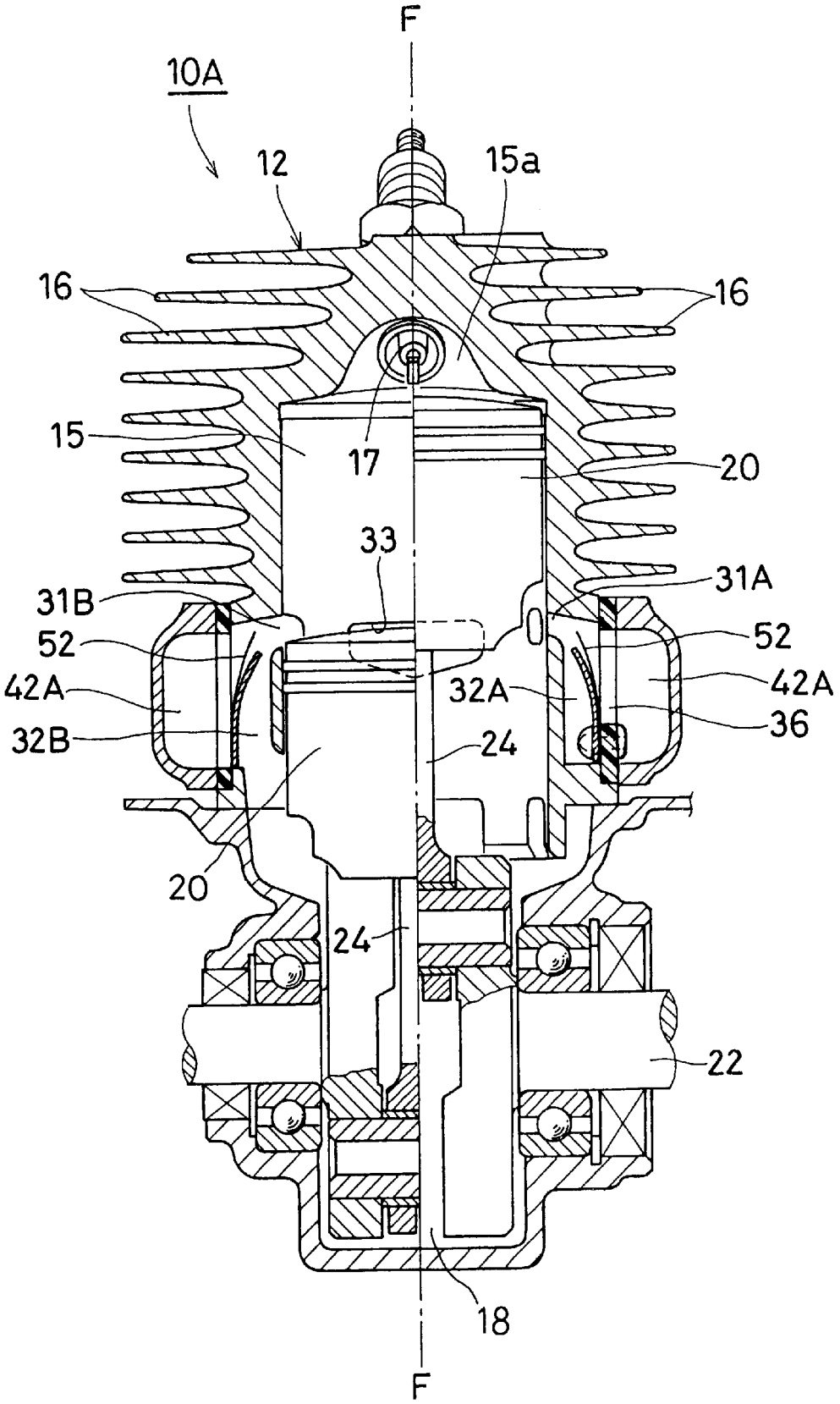
FIG. 7 is a cross-sectional view taken along the line VII—VII in FIG. 6.

For convenience of illustration and explanation, the part of the left side of the line F—F in FIG. 7 illustrates a longitudinal cross-sectional view taken along the end portion of the second scavenging port which is located close to the first scavenging port and shows the piston at bottom dead center, while the part to the right side of the line F—F in FIG. 7 illustrates a longitudinal cross-sectional view taken along the end portion of the first scavenging port which is located close to the second scavenging port and shows the piston at top dead center.

The two-stroke cycle internal combustion engine 10A according to the second embodiment is a small air-cooled two-stroke cycle gasoline engine having a quaternary scavenging system, which is adapted to be employed in a portable working machine. The engine 10A comprises a cylinder 12 in which a piston 20 is movably installed and a crankcase 14 axially supporting a crank shaft 22 for reciprocatively moving the piston 20 up and down through a connecting rod 24. The cylinder 12 is provided, on the outer circumferential wall thereof, with a plurality of cooling fins 16, and, at the head portion thereof, with a squish-dome shape (semi-spherical) combustion chamber 15*a* constituting a combustion actuating chamber 15. An ignition plug 17 protrudes into the combustion chamber 15*a*.

An exhaust port 34 is formed to one side (the right side in FIG. 6) of the trunk portion of the cylinder 12. A pair of first scavenging passages 32A disposed closer to the exhaust port 34 communicate the combustion actuating chamber 15 disposed above the piston 20 with the crank chamber 18 of the crankcase 14 and constitutes part of a Schnürle-type scavenging system. The passages 32A are symmetrically located with respect to the longitudinal plane F—F (FIG. 7) which imaginatively bisects the exhaust port 34. A pair of second scavenging passages 32B disposed farther from the exhaust port 34 communicate the combustion actuating chamber 15 disposed above the piston 20 with the crank chamber 18 of the crankcase 14 and constitutes part of the Schnürle-type scavenging system The passages 32B are symmetrically located with respect to the longitudinal plane F—F (FIG. 7) which imaginatively bisects the exhaust port 34.

At the upper end (downstream end) of the first scavenging passages 32A, there are formed a pair of first scavenging ports 31A which open to the combustion actuating chamber 15. At the upper end (downstream end) of the second scavenging passages 32B also, there are formed a pair of second scavenging ports 31B which open to the combustion actuating chamber 15.

In this case, the upper edges of the first scavenging ports 31A are at the same level as the upper edges of the second scavenging ports 31B, so that the scavenging ports 31A and 31B simultaneously open in the descending stroke of the piston 20.

Further, the aforementioned pair of first scavenging passages 32A as well as the aforementioned pair of second scavenging passages 32B are, respectively, so-called walled scavenging passageways wherein the side wall thereof which is close to the combustion actuating chamber 15 is designed to be closed by the inner wall of the cylinder 20. As clearly seen from FIGS. 8 and 9 in addition to FIGS. 6 and 7, the downstream side of the aforementioned pair of first scavenging passages 32A is extended downward along the elevational direction of the cylinder and parallel with the aforementioned pair of the second scavenging passages 32B. Additionally, the upstream side (the side disposed close to the crank chamber 18) of the aforementioned pair of first scavenging passages 32A is extended circularly and in a plane which orthogonally intersects with the downstream portion of the first scavenging passages 32A so as to encircle the combustion actuating chamber 15. Furthermore, the aforementioned pair of first scavenging passages 32A are combined together at the upstream end thereof which is disposed close to the crank chamber 18, and the entire length of the first scavenging passages 32A is enlarged, so that the capacity of the first scavenging passages 32A is made much larger than the capacity of the second scavenging passages 32B.

An upstream end portion 32*e* of the first scavenging passages 32A is contracted so as to prevent air A from back-flowing toward and escaping into the crank chamber 18.

On the other side of the cylinder 12 which is opposite to where the exhaust port 34 is located (the left side in FIG. 6), there is mounted, via a bored heat insulator 46 and a packing plate 49, a carburetor 40 functioning as an air-fuel mixture-generating device. An air cleaner 50 is attached to the upstream side of the carburetor 40.

The carburetor 40 includes an upstream portion of an air passageway 42 for conducting air A that has been cleaned by the air cleaner 50 to the first scavenging passageways 32A and an upstream portion of an air-fuel mixture passageway 41 for conducting an air-fuel mixture M that has been generated by the carburetor 40 to the combustion actuating chamber 15. The air passageway 42 and the air-fuel mixture passageway 41 are, respectively, provided with throttle valves 44 and 43, the throttle valves 44 and 43 being interlocked with each other through a link member 45.

Figure 8:
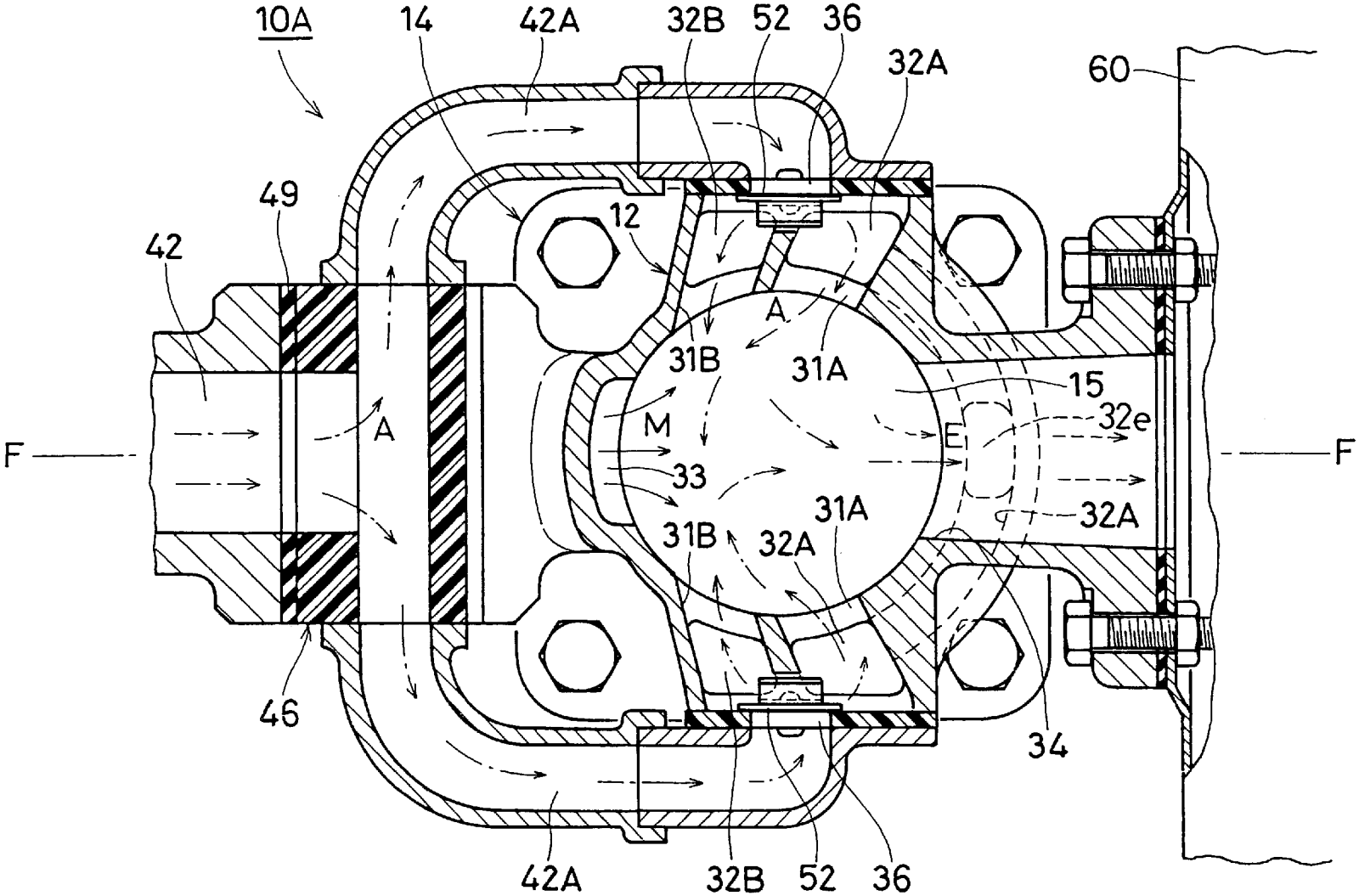
FIG. 8 is a cross-sectional view taken along the line VIII—VIII in FIG. 6.
Figure 9:
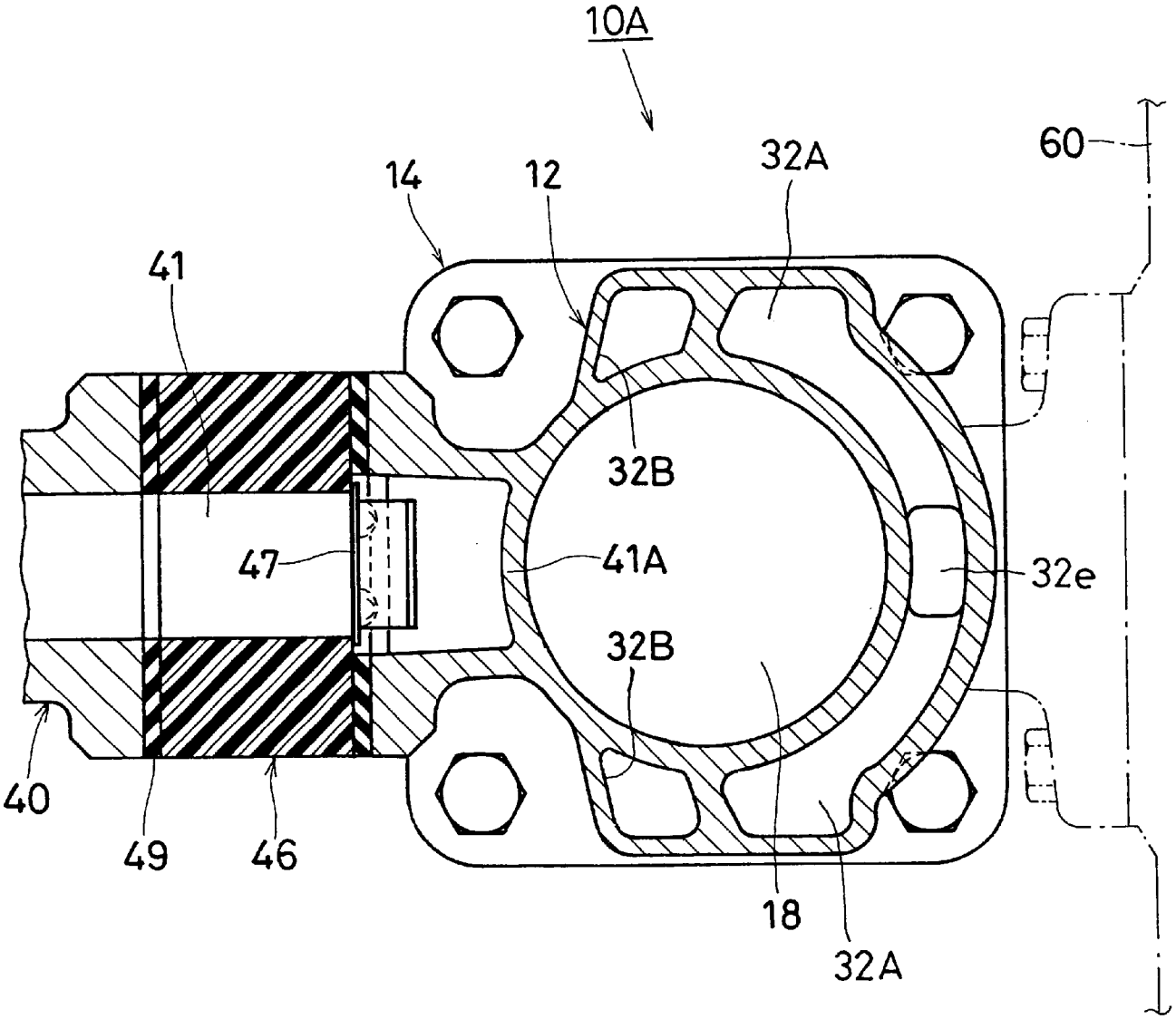
FIG. 9 is a cross-sectional view taken along the line IX—IX in FIG. 6.
Figure 10:
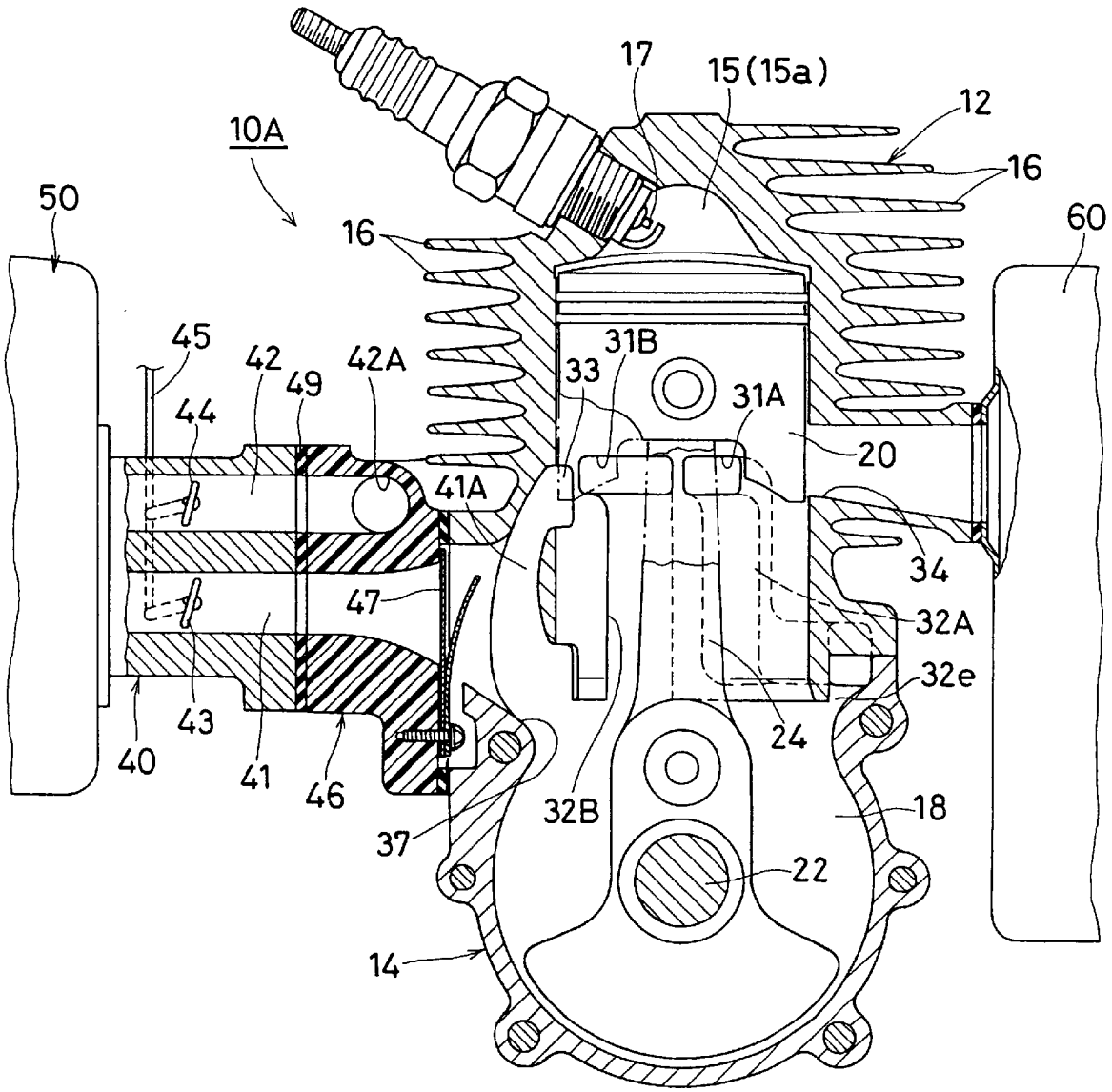
FIG. 10 is a longitudinal sectional view illustrating a state where the piston of the internal combustion engine shown in FIG. 6 is at the top dead center.

The air passageway 42 and the air-fuel mixture passageway 41 are arranged adjacent each other and one above the other and as clearly seen from FIGS. 7 and 8, the downstream side of the air passageway 42 is branched into two branch passageways 42A, the air outlet ports 36 of the downstream end thereof being disposed bridging over both of the first scavenging passageways 32A and the second scavenging passageways 32B. Additionally, stopper-attached reed valves 52 are mounted at the air outlet ports 36, the stopper-attached reed valves 52 functioning as a check valve for preventing air A from escaping toward the branch passageways 42A during the descending movement of the piston 20.

In the second embodiment, for the purpose of saving manufacturing cost, a single check valve (reed valve 52) is employed for use for both of the first scavenging passageways 32A and the second scavenging passageways 32B. However, these scavenging passageways 32A and 32B may be individually provided with a check valve.

The air-fuel mixture passageway 41 is also provided, at the downstream side thereof, with a stopper-attached reed valve 47 attached to the heat insulator 46 and functioning as a check valve for preventing air-fuel mixture M from back-flowing toward the carburetor 40.

Additionally, a communicating passageway 41A that communicates the combustion actuating chamber 15 with the crank chamber 18 is disposed at the downstream end of the air-fuel mixture passageway 41, and the downstream end (upper end) of the communicating passageway 41A is constituted by an air-fuel mixture-feeding port 33 which opens to the combustion actuating chamber 15 located over the piston 20, thereby allowing the air-fuel mixture M to blow out from an air-fuel mixture-feeding port 33 as well as from the second scavenging ports 31B attached to the downstream end of the second scavenging passageways 32B toward the combustion chamber 15*a* of the combustion actuating chamber 15. At the same time, the air-fuel mixture M coming from the air-fuel mixture passageway 41 and the communicating passageway 41A is also allowed to be introduced into the crank chamber 18 through a crank chamber port 37.

In the operation of the two-stroke cycle internal combustion engine 10A of the second embodiment, which is constructed as described above, ambient air A is introduced through the air passageway 42 into the first scavenging passageways 32A, the second scavenging passageways 32B and the crank chamber 18, and held therein in the ascending stroke of the piston 20. Additionally, the air-fuel mixture M is introduced from the air-fuel mixture-generating device (the carburetor 40) into the air-fuel mixture passageway 41 and the crank chamber 18.

When the air-fuel mixture M inside the combustion actuating chamber 15 disposed above the piston 20 is ignited and burns, the piston 20 is pushed down due to the generation of a combustion gas. In the descending stroke of the piston 20, the air A and air-fuel mixture M existing inside the crank chamber 18, the first scavenging passageways 32A and the second scavenging passageways 32B is compressed. The exhaust port 34 opens first, and when the piston 20 has further descended, the first scavenging ports 31A formed at the downstream end of the first scavenging passageways 32A and the second scavenging ports 31B formed at the downstream end of the second scavenging passageways 32B are concurrently opened.

In the initial stage of the scavenging period during which the first and second scavenging ports 31A and 31B are opened, only the air A compressed by the piston 20 and present in the first and second scavenging passageways 32A and 32B is allowed to be introduced into the combustion actuating chamber 15 from the first and second scavenging ports 31A and 31B.

Subsequently, when the piston 20 has further descended, the air A held in the first scavenging passageways 32A is allowed to be continuously introduced into the combustion actuating chamber 15 from the first scavenging ports 31A (the air is introduced throughout the entire scavenging period), whereas the introduction of air A into the combustion actuating chamber 15 from the second scavenging ports 31B ends. In that regard, when a certain period of time has elapsed after the second scavenging ports 31B have opened, since all of the air A inside the second scavenging passageways 32B will have already been introduced into the combustion actuating chamber 15 from the second scavenging ports 31B, the air-fuel mixture M that has been precompressed in the crank chamber 18 is introduced, following the aforementioned accomplishment of the introduction of air A, from the second scavenging ports 31B via the second scavenging passageways 32B into the combustion actuating chamber 15 until the scavenging period ends.

During the descending stroke of the piston 20, air A is allowed to be introduced into the combustion actuating chamber 15 from the second scavenging ports 31B prior to the introduction of the air-fuel mixture M (shown by a solid arrow in FIGS. 6 and 8) and at the same time, a relatively large quantity of air A (shown by a dot-and-dash arrow in FIGS. 6 and 8) is allowed to be introduced into the combustion actuating chamber 15 from the first scavenging ports 31A over a longer period of time as compared with a period of time in which air A is introduced from the second scavenging ports 31B.

When the piston 20 further descends after the first and second scavenging ports 31A and 31B have opened, the air-fuel mixture-feeding port 33 is opened a moment after the first and second scavenging ports 31A and 31B have opened (e.g., about 10 degrees later in terms of the crank angle), thereby allowing the relatively condensed air-fuel mixture M existing inside the air-fuel mixture passageway 41 and the crank chamber 18 to be blown from the air-fuel mixture-feeding port 33 into the combustion chamber 15*a* of the combustion actuating chamber 15 until the scavenging period ends, thereby allowing the air-fuel mixture M to circulate in the vicinity of the combustion chamber 15*a*.

In the case of the quaternary scavenging type two-stroke cycle internal combustion engine 10 according to the first embodiment, in which the first scavenging port is exclusively used for air and the second scavenging port is exclusively used for an air-fuel mixture, a quantity of combustion exhaust gas is allowed to remain in the vicinity of the inner wall of the cylinder 12 which is located opposite to the exhaust port 34. By contrast, in the two-stroke cycle internal combustion engine 10A of the second embodiment, since only air A is introduced into the combustion actuating chamber 15 from both of the first and second scavenging ports 31A and 31B in the initial stage of the scavenging period, the combustion exhaust gas E (shown by a broken arrow in FIGS. 6 and 8) is substantially not allowed, due to the air A, to remain in the cylinder, including a region in the vicinity of the inner wall of the cylinder 12 which is located opposite to the exhaust port 34, but is caused to be pushed toward the exhaust port 34 so as to be discharged outside via a muffler 60.

At the same time, a layer of air A is formed between the combustion exhaust gas E and the air-fuel mixture M that has been introduced later into the combustion actuating chamber 15 from the air-fuel mixture-feeding port 33 and the second scavenging ports 31B. Therefore, due to the layer of air A, a mixing between the air-fuel mixture M and the combustion exhaust gas E can be effectively prevented, thereby realizing an almost complete stratified scavenging.

In the internal combustion engine 10A of the second embodiment, the first scavenging passageways 32A are employed exclusively for the passage of air A, while the second scavenging passageways 32B are employed exclusively for the passage of air-fuel mixture M in a later stage of the scavenging period after an initial period in which air A is supplied from the second passages 32B. The air-fuel mixture-feeding port 33 is opened a moment later after the first scavenging ports 31A and the second scavenging ports 31B are opened, thereby allowing a relatively condensed air-fuel mixture M to be blown out of the second scavenging ports 31B and the air-fuel mixture-feeding port 33 toward the combustion chamber 15*a* of the combustion actuating chamber 15 after a middle stage of the scavenging period, thereby preventing the air-fuel mixture M thus blown out from being mixed with the combustion exhaust gas E due to the presence of the layer of air A that has been previously introduced, thus enabling the air-fuel mixture M to circulate in the vicinity of the combustion chamber 15*a* and hence promoting a stratified combustion. As a result, the quantity of blow-by can be reduced to a minimum, and at the same time, the air-fuel mixture M can be easily ignited, thus making it possible to improve the fuel consumption and to reduce the content of undesirable components in the exhaust gas.

Further, since the air passageway 42 and the air-fuel mixture passageway 41 are arranged side by side, the parts of the engine 10A can be rationally and compactly arranged, thus making it possible to easily mount the engine 10A on a portable power working machine.

Furthermore, since the feeding of air is conducted not through an outside pump, but through a piston pumping, the entire structure of the engine 10A can be simplified and the manufacturing cost of the engine 10A can be reduced.

In the second embodiment, the upper edges of the first scavenging ports 31A are located at the same level as the upper edges of the second scavenging ports 31B, so that the scavenging ports 31A and 31B are designed to be simultaneously opened in the descending stroke of the piston 20. However, the elevational positions of the first scavenging ports 31A and the second scavenging ports 31B may not necessarily be the same level with each other; i.e., there may be a difference in elevational position between the first scavenging ports 31A and the second scavenging ports 31B. Not only the elevational position, but also the configuration, opening area and horizontal scavenging angle of each of the first and second scavenging ports 31A and 31B may be optionally designed as long as they make it possible to realize a stratified scavenging and also to enhance the effect of scavenging the residual combustion exhaust gas E.

Additionally, the capacity of the first scavenging passageways 32A as well as the capacity of the second scavenging passageways 32B may be optionally designed by taking into consideration the target air-fuel ratio of the air-fuel mixture to be provided for combustion in the combustion actuating chamber 15.

Although two embodiments of the present invention have been explained in the foregoing explanation, it should be understood that the present invention is not limited to these embodiments, but can be varied without departing from the spirit and scope of the invention set forth in the accompanying claims.

As seen from the above explanation, it is possible, according to the present invention, to provide a two-stroke cycle internal combustion engine with a quaternary scavenging system, which is capable of minimizing the quantity of blow-by, capable of improving the fuel consumption and power of the engine, capable of reducing the content of undesirable components in the exhaust gas, and capable of rationally and compactly arranging the parts of the engine.

What is claimed is:

1. A two-stroke cycle internal combustion engine, comprising a cylinder and a piston defining a combustion actuating chamber;

a crankcase below the piston and defining a crank chamber; and a Schnürle-type scavenging system that includes an exhaust port, a pair of first scavenging passageways communicating the combustion actuating chamber with the crank chamber and disposed closer to the exhaust port, the first scavenging passageways being disposed symmetrically with respect to a longitudinal plane that bisects the exhaust port, a pair of second scavenging passageways communicating the combustion actuating chamber with the crank chamber and disposed farther from the exhaust port, the second scavenging passageways being disposed symmetrically with respect to the longitudinal plane, an air passageway for introducing air into the first scavenging passageways, and an air-fuel mixture passageway for introducing an air-fuel mixture from an air-fuel mixture-generating device into the crank chamber, and wherein the scavenging system is configured such that during a descending stroke of the piston, the exhaust port opens first, a first scavenging port formed at a downstream end of each first scavenging passageway opens after the exhaust port opens, and a moment later, a second scavenging port disposed at a downstream end of each second scavenging passageway opens, whereby air is introduced into the combustion actuating chamber from each first scavenging port prior to the introduction of the air-fuel mixture into the combustion actuating chamber from each second scavenging port.

2. The two-stroke cycle internal combustion engine according to claim 1, and further comprising a communicating passageway communicating with the downstream end of the air-fuel mixture passageway and communicating the crank chamber with the combustion actuating chamber via an air-fuel mixture-feeding port provided at the downstream end of the communicating passageway, the air-fuel mixture-feeding port being configured to open substantially simultaneously with the second scavenging ports.

3. The two-stroke cycle internal combustion engine according to claim 1 or 2, wherein the air passageway has a check valve and the air-fuel mixture passageway has a check valve.

4. The two-stroke cycle internal combustion engine according to claim 1 or claim 2, wherein said pair of first scavenging passageways are joined at a location close to the crank chamber.

5. The two-stroke cycle internal combustion engine according to claim 1 or claim 2, wherein end portions of the pair of first scavenging passageways which are disposed close to the crank chamber are contracted.

6. The two-stroke cycle internal combustion engine according to claim 1 or claim 2, wherein the air-fuel mixture passageway is provided with a single check valve.

7. The two-stroke cycle internal combustion engine according to claim 1 or claim 2, wherein the air passageway and the air-fuel mixture passageway are arranged side by side.

8. The two-stroke cycle internal combustion engine according to claim 1 or claim 2, wherein the scavenging system is configured such that the air-fuel mixture blown out of the air-fuel mixture-feeding port of the communicating passageway is blown toward a combustion chamber portion of the combustion actuating chamber.

9. The two-stroke cycle internal combustion engine according to claim 1 or claim 2, wherein the air-fuel mixture-generating device is a carburetor, and the carburetor incorporates a portion of the air passageway and a portion of the air-fuel mixture passageway, each such portion being provided with a throttle valve, and wherein the throttle valves are interlocked with each other.

10. A two-stroke cycle internal combustion engine, comprising a cylinder and a piston defining a combustion actuating chamber above the piston;

a crankcase below the piston and defining a crank chamber; and a Schnürle-type scavenging system that includes an exhaust port, a pair of first scavenging passageways communicating the combustion actuating chamber with the crank chamber and disposed closer to the exhaust port, the first scavenging passageways being disposed symmetrically with respect to a longitudinal plane that bisects the exhaust port, a pair of second scavenging passageways communicating a combustion actuating chamber with the crank chamber and disposed farther from the exhaust port, the second scavenging passageways being disposed symmetrically with respect to the longitudinal plane, an air passageway for introducing air into the first scavenging passageway; and an air-fuel mixture passageway for introducing an air-fuel mixture from an air-fuel mixture-generating device into the crank chamber, wherein the scavenging system is configured such that during the descending stroke of the piston and at least in the initial stage of a scavenging period during which a first scavenging port formed at a downstream end of each first scavenging passageway and a second scavenging port formed at a downstream end of each second scavenging passageway are opened, only air is allowed to be introduced into the combustion actuating chamber from the first and second scavenging ports.

11. The two-stroke cycle internal combustion engine according to claim 10, wherein the scavenging system is configured such that during the descending stroke of the piston, air is allowed to be introduced into the combustion actuating chamber from each second scavenging port prior to the introduction of the air-fuel mixture and at the same time, a relatively large quantity of air is allowed to be introduced into the combustion actuating chamber from each first scavenging port over a longer period of time as compared with a period of time in which air is introduced from the second scavenging port.

12. The two-stroke cycle internal combustion engine according to claim 10 or claim 11, wherein the flow capacity of each second scavenging passageway is made larger than the flow capacity of each first scavenging passageway.

13. The two-stroke cycle internal combustion engine according to claim 10 or claim 11, wherein the scavenging system is configured such that only air is allowed to be introduced through each first scavenging port into the combustion actuating chamber throughout the entire scavenging period.

14. The two-stroke cycle internal combustion engine according to claim 10 or claim 11, wherein the scavenging system further includes a communicating passageway communicating the crank chamber with the combustion actuating chamber at the downstream end of the air-fuel mixture passageway, and the scavenging system is configured such that during the descending stroke of the piston, the exhaust port is first opened, the first scavenging port and the second scavenging port are then opened, and a moment later, an air-fuel mixture-feeding port provided at the downstream end of the communicating passageway is opened, and such that air is introduced into the combustion actuating chamber prior to the introduction of the air-fuel mixture.

15. The two-stroke cycle internal combustion engine according to claim 10 or claim 11, wherein the scavenging system is configured such that during the descending stroke of the piston, the exhaust port is first opened, and then, the first scavenging port and the second scavenging port are simultaneously opened.

16. The two-stroke cycle internal combustion engine according to claim 10 or claim 11, wherein the air passageway is provided with a check valve.

17. The two-stroke cycle internal combustion engine according to claim 10 or claim 11, wherein an air outlet port disposed at the downstream end of the air passageway is communicated with both the first scavenging passageways and the second scavenging passageways, and the air outlet port is provided with a single check valve.

18. The two-stroke cycle internal combustion engine according to claim 10 or claim 11, wherein said pair of first scavenging passageways are joined at a location close to the crank chamber.

19. The two-stroke cycle internal combustion engine according to claim 10 or claim 11, wherein end portions of the pair of first scavenging passageways which are disposed close to the crank chamber are contracted.

20. The two-stroke cycle internal combustion engine according to claim 10 or claim 11, wherein the air-fuel mixture passageway is provided with a single check valve.

21. The two-stroke cycle internal combustion engine according to claim 10 or claim 11, wherein the air passageway and the air-fuel mixture passageway are arranged side by side.

22. The two-stroke cycle internal combustion engine according to claim 10 or claim 11, wherein the scavenging system is configured such that the air-fuel mixture blown out of the air-fuel mixture-feeding port of the communicating passageway is blown toward a combustion chamber portion of the combustion actuating chamber.

23. The two-stroke cycle internal combustion engine according to claim 10 or claim 11, wherein the air-fuel mixture-generating device is a carburetor, and the carburetor incorporates a portion of the air passageway and a portion of the air-fuel mixture passageway, each such portion being provided with a throttle valve, and wherein the throttle valves are interlocked with each other.

* * * * *